United States Patent [19]

McGaffigan

[11] Patent Number: 4,462,651

[45] Date of Patent: Jul. 31, 1984

[54] REUSABLE HEAT-RECOVERABLE CONNECTING DEVICE

[75] Inventor: Thomas H. McGaffigan, Orinda, Calif.

[73] Assignee: Raychem Corporation, Menlo Park, Calif.

[21] Appl. No.: 436,201

[22] Filed: Dec. 10, 1982

[51] Int. Cl.[3] ..... H01R 13/20

[52] U.S. Cl. ..... 339/30; 339/DIG. 1; 174/DIG. 8

[58] Field of Search ..... 339/30, DIG. 1; 174/DIG. 8

[56] References Cited

U.S. PATENT DOCUMENTS

| | | | |
|---|---|---|---|
| 3,622,941 | 11/1971 | Wetmore | 339/DIG. 1 X |
| 3,913,444 | 10/1975 | Otte | 339/30 X |
| 3,990,765 | 11/1976 | Hill | 339/DIG. 1 X |
| 4,168,192 | 9/1979 | Nyberg | 174/DIG. 8 X |
| 4,221,457 | 9/1980 | Allen et al. | 339/DIG. 1 X |
| 4,424,411 | 1/1984 | Clabburn | 174/DIG. 8 |

FOREIGN PATENT DOCUMENTS

| | | | |
|---|---|---|---|
| 294249 | 12/1916 | Fed. Rep. of Germany | 339/30 |

*Primary Examiner*—Joseph H. McGlynn
*Assistant Examiner*—Steven C. Bishop
*Attorney, Agent, or Firm*—James W. Peterson

[57] ABSTRACT

A reusable heat-recoverable connecting device having an annular driver member and a circumferentially split annular spring biasing means inside and generally concentric with the driver member. The spring biasing means normally exerts an outward radial force against the inside surface of the driver member. The driver member is made from a heat-recoverable metal having a martensitic state and an austenitic state. The driver member is expanded radially outward by the spring biasing means when the driver member is in its martensitic state to facilitate insertion of a substrate. The driver member recovers to its non-expanded dimension when it returns to its austenitic state to cause engagement between the spring biasing means and an inserted substrate.

16 Claims, 14 Drawing Figures

REUSABLE HEAT-RECOVERABLE CONNECTING DEVICE

FIELD OF THE INVENTION

This invention relates to reusable devices for making electrical connections and more particularly to those devices which include a heat-recoverable metal driver.

BACKGROUND OF THE INVENTION

Electrical connections have, until recently, largely depended upon traditional methods such as soldering and crimping to effect connection of, for example, conductors and cable shields. In simple applications both of these traditional methods are quite satisfactory. However, these methods are basically permanent in nature. In view of these methods, it remains highly desirable to have a connection of like integrity but which is removable and reusable.

Reusable connectors using a driver member made from a heat-recoverable metal capable of reversing between a martensitic state and an austenitic state have been developed. Such devices are disclosed in commonly assigned U.S. Pat. No. 4,022,519 ("'519"), U.S. Pat. No. 3,861,030 ("'030") and U.S. Pat. No. 3,740,839 ("'839") all of which are incorporated herein by reference. The history of these connectors is generally set forth in '519.

The above-mentioned connectors all have in common an inner socket insert which is shaped generally in the form of a tuning fork having a pair of tines. The tines of '030 and '839 are spring biased to expand a surrounding solid driver of heat-recoverable metal when the metal is in its martensitic site. As will be explained in more detail later, the outward force exerted by the tines on the driver is dependent, among other things, upon the length of the tines. The result is a device which exerts high force but is tine-length dependent. The significance of tine-length dependency will be discussed later with reference to FIG. 8 of the drawing.

Another device utilizing heat-recoverable metal is disclosed in commonly assigned U.S. Pat. No. 3,913,444 ('444), which is incorporated herein by reference. The device of '444 utilizes a split driver of heat-recoverable metal surrounding a socket insert composed of a spring-like material having sufficient strength to move the driver when the driver is in its martensitic state. The device of '444 is formed by taking split cylinders of each material and force fitting the two together. While '444 is somewhat more compact than the previously discussed devices, the connecting force generated by the device is comparatively low due to the split driver which depends upon recovery in bending versus the recovery due to hoop forces generated by a continuous or solid driver. Consequently, large contact forces cannot be applied to the substrate by the split driver of '444. The result is a device which exerts low force but is not tine-length dependent.

Yet another connector utilizing heat-recoverable metal is disclosed in commonly assigned patent application Ser. No. 328,161 ('161), filed Dec. 7, 1981, which is incorporated herein by reference. This connector also utilizes a socket insert in the form of a tuning fork having tines similar to the devices disclosed in '030 and '839 discussed earlier. The tines of '161 coact with a split driver of heat-recoverable metal in the form of cantilevered arms to produce a connector having a large range of movement but which like the device of '444, generates low force and which like '519, '030 and '839, is dependent upon the length of the tines.

The instant invention utilizes a solid heat-recoverable metal driver and a split ring socket insert to produce a device which generates high force but is not tine-length dependent. The result is a device which generates the high force of the tine-length dependent devices utilizing solid drivers but is so compact that the socket insert may be wholely contained within the driver.

SUMMARY OF THE INVENTION

The purpose of the instant invention is to provide a reusable heat-recoverable connecting device which generates high contact force and which is compact and is specifically not tine-length dependent. To accomplish this purpose, the invention provides an annular driver member of heat-recoverable metal having a martensitic state and austenitic state wherein the driver member may be expanded when in its martensitic state. The driver member recovers when in its austenitic state to its non-expanded dimension. The invention also provides at least one circumferentially split annular spring biasing means which exerts a radially outward force against the inside of the driver member. The driver member overcomes the outward force when changed from its martensitic state to its austenitic state thereby causing engagement between the spring biasing means and a substrate that may be inserted inside of said spring biasing means. The spring biasing means expands the driver means radially outward to release the substrate when the driver member changes from its austenitic state to its martensitic state.

One aspect of this invention includes a reusable connecting device comprising:

an annular driver member having a continuous inside contact surface, said driver member being made from a heat-recoverable metal having a martensitic state and an austensitic state, said driver member being expanded radially outward while in its martensitic state, a change from its martensitic state to its austenitic state recovering said driver member to its non-expanded dimension; and at least one circumferentially split annular spring biasing means inside and generally concentric with said driver member, said spring biasing means contacting and exerting a radially outward force against the inside contact surface of said driver member, said driver member overcoming said force when changed from its martensitic state to its austensitic state recovering to its non-expanded dimension causing engagement between said spring biasing means and a substrate that may be inserted inside of said spring biasing means, said spring biasing means expanding said driver means radially outward releasing such a substrate when said driver member changes from its austenitic state to its martensitic state.

In one embodiment of the instant invention, diametrical reduction of the driver member effects a proportional inside diametrical reduction of the spring biasing means so that it may engage a substrate that may be inserted therein. In this embodiment, the radial cross section of the spring biasing means is preferably nonuniform, specifically, the middle portion is relatively thicker than the end portions of the C-shaped spring biasing means. Upon recovery of the driver member, the thinner end portions of the spring biasing means deflect more than the thicker middle portion promoting a generally uniform gripping force on the substrate inserted therein. The thicker middle portion also accommodates the concentration of bending stress in the middle portion of the spring biasing means.

In an alternate embodiment of the instant invention, the net reduction of the engagement dimension is the sum of the proportional diametrical change of the spring biasing means and the additional change due to tanslational movement of the ends of the spring biasing means. In this embodiment, the end sections of a C-shaped spring biasing means having a uniform radial cross section each have generally parallel abutting surfaces which are at an angle to the radial axis of said spring biasing means to define sliding surfaces. Recovery of the driver member not only diametrically reduces the spring biasing means in general but also causes one of said end sections to slid generally radially inward relative to the other end section to effect a further reduction of the engagement diameter of the spring biasing means.

Similarly, another related embodiment provides a spring biasing means wherein both end sections of a C-shaped spring biasing means project radially inwardly to engage a substrate such as a flat pin which may be inserted beween the respective ends. In this embodiment, recovery of the driver member causes a circumferential reduction of the spring biasing means and thus a reduction of the engagement dimension of the spring biasing means.

In yet another embodiment of the instant invention, a plurality of axially aligned spring biasing means are provided, the slots of said respective spring biasing means being circumferentially and axially staggered with respect to each other. Each of the spring biasing means are C-shaped and have a uniform thickness in radial cross section. The staggered slots result in an overall engagement force that is spread out along the surface of the substrate.

The above-mentioned embodiment utilizing the plurality of spring biasing means which are circumferentially staggered with respect to each other leads to yet another embodiment in which the spring biasing means is circumferentially split in the form of a helix. In this embodiment, the single helically split spring biasing means provides high gripping force without causing deformation of a substrate upon recovery of the driver member.

A BRIEF DESCRIPTION OF THE DRAWING

DESCRIPTION OF THE PREFERRED EMBODIMENT

Figure 1:
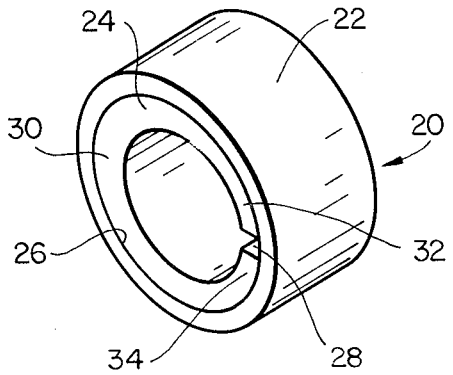
FIG. 1 is a perspective view of a reusable heat-recoverable connecting device of the instant invention.

With reference to the drawing, FIG. 1 illustrates a reusable connecting device generally referred to by the numeral 20. Connecting device 20 includes an annular driver member 22 and a circumferentially split annular spring biasing means 24 inside and generally concentric with the driver member 22. Driver member 22 is made from a heat-recoverable metal such as nickel titanium alloy. Other heat-recoverable metals suitable for use in the instant invention are set forth in the '839 patent discussed earlier and also in U.S. Pat. No. 3,753,700 ('700) which is also incorporated herein by reference. Driver member 22 is made from a heat-recoverable metal having a martensitic state and an austenitic state. As discussed in the above-mentioned patent, heat-recoverable metal alloys undergo a transition between an austenitic and a martensitic state at certain temperatures. When they are deformed while they are in the martensitic state, they will retain this deformation while maintained in this state, but, will revert to their original non-deformed configuration when they are heated to a temperature at which they transform to their austenitic state. This ability to recover upon warming is utilized in the instant invention. The temperatures at which these transitions occur are effected, of course, by the nature of the alloy.

Driver member 22 has been expanded radially outward while in its martensitic state. A change from its martensitic state to its austenitic state will recover the driver member 22 to its non-expanded dimension.

Circumferentially split annular spring biasing means 24 is mounted inside and concentric with the driver member 22. Spring biasing means 24 contacts and exerts a radially outward force against the inside contact surface 26 of driver member 22. Spring biasing means 24 is circumferentially split at 28.

Spring biasing means 24 is made from material which has a sufficient bending strength to expand driver member 22 radially outward when driver member 22 is in its martensitic state. Spring biasing means 24 is preferably made from beryllium copper alloy.

In operation, spring biasing means 24 contacts and exerts a radially outward force against the inside contact surface 26 of the driver member 22. Driver member 22 overcomes this force when the driver member 22 changes from its expanded martensitic state to its austenitic state recovering to its non-expanded dimension causing engagement between the spring biasing means 24 and a substrate (not shown) that may be inserted inside of the spring biasing means 24. As mentioned earlier, the spring biasing means 24 is capable of expanding the driver member radially outward to release such a substrate when the driver member 22 changes from its austenitic state to its martensitic state.

Spring biasing means 22 is generally C-shaped and in the embodiment illustrated in FIG. 1, the radial cross section of the spring biasing means 24 is non-uniform. Specifically, spring biasing means 24 comprises a middle section 30 and end sections 32 and 34. It can be seen in FIG. 1 that middle section 30 is relatively thicker in radially cross section than end sections 32 and 34. Recovery of the driver member 22 to its non-expanded dimension defines a diametrical reduction of the driver member which effects a proportional diametrical reduction of the spring biasing means 24 so that it may engage a substrate that may be inserted therein. The diametrical reduction of the spring biasing means 24 causes a bending stress concentration on middle section 30. The thicker middle portion 30 accommodates this concentration of bending stress. In addition, the relatively thinner end portions 32 and 34 deflect more than the thicker middle portion 30 promoting a generally uniform gripping force on a substrate inserted therein. It can be seen that the split 28 makes it possible for recovery of the driver member 22 to effect an inside diametrical reduction of the spring biasing means 24 for purpose of engagement of a substrate that may be inserted within the spring biasing means.

Figure 2:
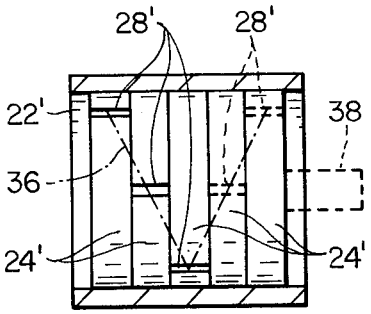
FIG. 2 is a cross-sectional view of an alternate embodiment of the instant invention wherein a plurality of spring biasing means are utilized.

FIG. 2 illustrates an alternative embodiment of the instant invention wherein a plurality of spring biasing means 24' are utilized. In this embodiment, the slots 28' of the respective spring biasing means 24' are circumferentially and axially staggered with respect to each other. The slots 28' define a helical path around the inside surface of driver member 22' as noted by phantom line 36. The overall engagement force in this embodiment is thus spread out along the surface of a substrate (not shown) that may be inserted axially inside a plurality of spring biasing means 24'. The device of FIG. 2 may further include optional electrically conductive elements for electrical connection purposes such as element 38 shown in phantom as being attached to one of the spring biasing means 24'.

Figure 3:
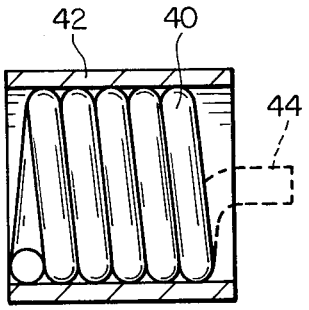
FIG. 3 is yet another alternate embodiment of the instant invention wherein a spring biasing means which is circumferentially split in the form of a helix is utilized.

FIG. 3 illustrates yet another embodiment of the instant invention wherein a spring biasing means 40 which is circumferentially split in the form of a helix 42 is utilized. This embodiment is related to that shown in FIG. 2 where the path 36, the slots 28' defined a helix. Spring biasing means 40 may also be provided with an electrically conductive element shown in phantom at 44. It can be seen in FIG. 3, spring biasing means 40 may in fact be in the form of a helically wound wire of suitable spring like material such as beryllium copper alloy and that an electrically conductive element 44 for electrical connection purposes may be made integral therewith.

Figure 4A:
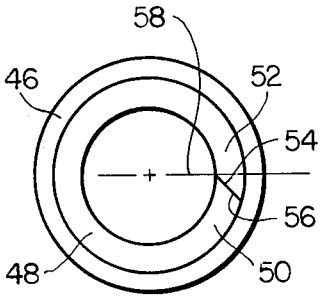
FIG. 4A is a side view of an alternate embodiment of the instant invention prior to recovery of the driver member wherein the end sections of the spring biasing means abutt.
Figure 4B:
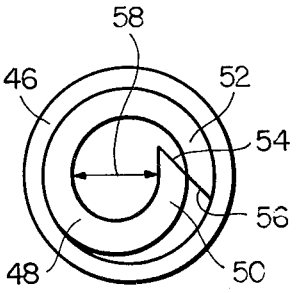
FIG. 4B illustrates the device shown in 4A after recovery of the driver member.

FIG. 4 illustrates another embodiment of the instant invention having a driver member 46 and spring biasing means 48. Again spring biasing means 48 is C-shaped and has a generally uniform radial cross section. The end section 50 and 52 have generally parallel abutting surfaces 54 and 55, respectively. Surfaces 54 and 56 are at an angle to the radial axis of the spring biasing means 48. Surfaces 54 and 56 define sliding surfaces, i.e., they slide with respect to each other as can be seen by a comparison of FIGS. 4A and 4B.

In the device illustrated in FIGS. 4A and 4B, a diametrical change of the driver member 46 effects a proportional diametrical change as discussed with respect to FIG. 1. Further change in the engagement dimension is effected by utilizing the circumferential change of the spring biasing means 48 as it is applied to end sections 50 and 52. It can be seen by a comparison of FIGS. 4A with 4B that recovery of the driver member 46 will cause end section 50 to slide generally radially inward relative to end section 52 to effect a further reduction in the engagement dimension of the spring biasing means 48. The net engagement dimension of spring biasing means 48 is shown generally by dimension 58 in FIG. 4B. It can be seen that the net reduction in engagement dimension is the sum of the proportional diametrical change of the spring biasing means and the additional change due to the sliding of ends, said additional change being $\pi$ (3.1416 . . . ) times the diametrical change of the driver members.

Figure 4C:
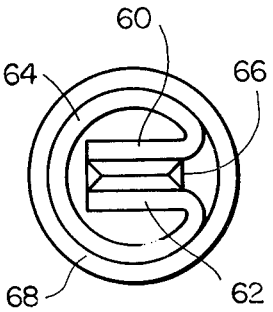
FIG. 4C is a side view of still another alternate embodiment wherein the end sections of the spring biasing means extend radially inward to engage a substrate therebetween. The figure illustrates the device after recovery of the driver member.

FIG. 4C illustrates wherein an embodiment similar to that disclosed in FIGS. 4A and 4B, wherein a pair of end sections 60 and 62 of the spring biasing means 64 extend radially inward in parallel spaced apart fashion to define a substrate engagement space therebetween. The substrate is shown as flat pin 66. The device of FIG. 4C is shown with the driver member 68 in its recovered dimension. In this embodiment, circumferential reduction of the spring biasing means alone is utilized to cause reduction of the engagement dimension of the spring biasing means 64.

The reduction in the engagement dimension in the FIG. 4C embodiment is similar to the change in slot dimension of slot 28 in FIG. 1. It can be appreciated that the reduction of the slot dimension is a function of the circumferential reduction alone. It can also be appreciated that the change in the engagement dimension effected by using circumferential change rather than diametrical change is $\pi$ (3.1416 . . . ) times the diametrical change. In order to increase the engagement surface area and allow liberal pin tolerances of pin 66, it is necessary to extend the end sections 60 and 62 radially inward.

Figure 5A:
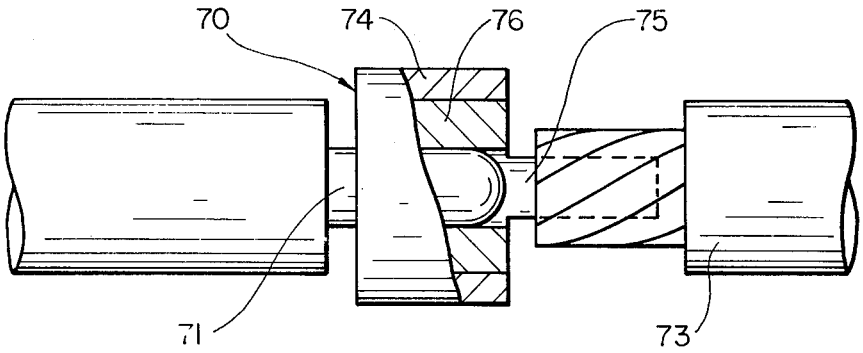
FIGS. 5A and 5B illustrate in partial cross sectional view a device similar to that shown in FIG. 1 wherein the device is used as either a conductor connecting device or as a cable shield termination device.
Figure 5B:
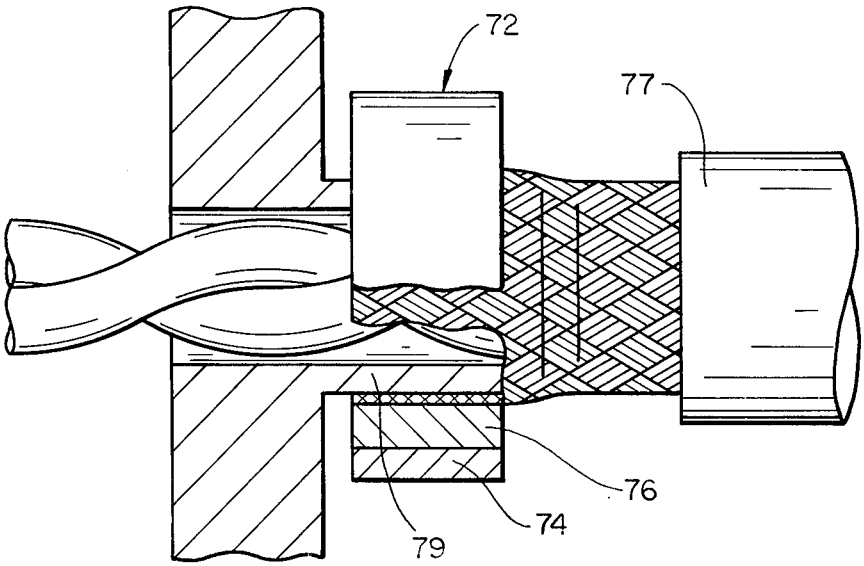

With reference to FIGS. 5A and 5B, there is shown an embodiment of the connecting device in accordance with this invention generally indicated by the numerals 70 and 72. Each device includes a driver member 74 and a spring biasing means 76. Device 70 illustrates the instant invention used as a means for electrical connection such as for connecting a pin 71 to a wire 73. For this purpose, device 70 includes a conductive element 75 extending from spring biasing means 76.

FIG. 5B illustrates device 72 utilized to terminate the shielding of a cable 77 to the turret 79 of a bulkhead.

Figure 6A:
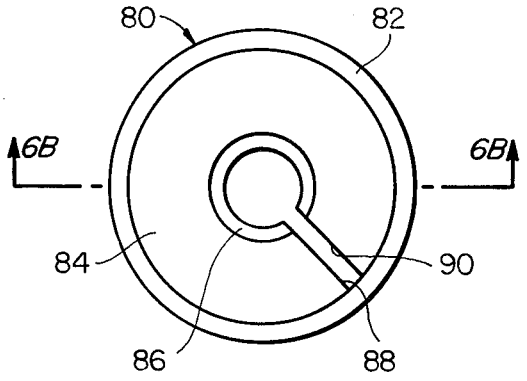
FIG. 6A illustrates in plan view an alternate embodiment of the instant invention wherein the spring biasing means is internally chamfered to define a force translating stop means.
Figure 6B:
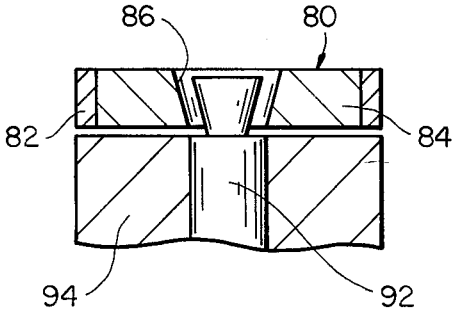
FIG. 6B illustrates in cross sectional side view device of FIG. 6A prior to recovery of the driver member.
Figure 6C:
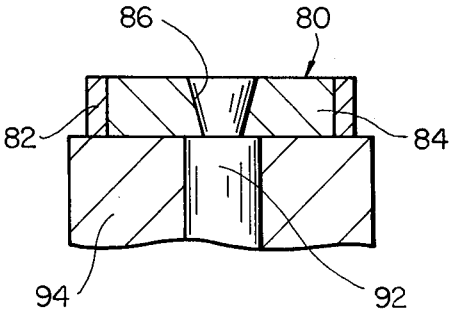
FIG. 6C illustrates the device shown in FIG. 6B after recovery of the driver member.

With particular reference to FIGS. 6A, 6B and 6C, there is shown in another alternative embodiment in accordance with this invention indicated generally by the numeral 80. Device 80 includes a spring biasing means which comprises a disc-like member 84 having a center opening, the periphery of said opening comprising a chamfered surface 86. Device 80 may be positioned over a pin 92 having a chamfered portion thereof which is complementary to chamfered surface 86 of the device 80. In this embodiment, a substrate 94 may be placed over pin 92.

It can be seen by a composition of FIG. 6B with FIG. 6C that recovery of driver member 82 will effect a diametrical reduction of the spring biasing means 84. The contact of the complementary chamfered surfaces causes a wedging action during recovery of driver member 82 which brings the device 80 and the substrate 94 into close contact as illustrated in FIG. 6C. It can be seen that device 80 thus translates the diametrical recovery forces of the driver member 82 into a wedging action to provide a stop means.

Figure 7A:
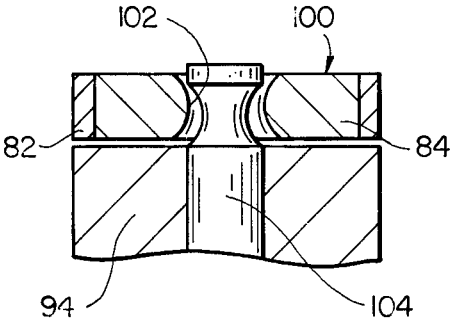
FIGS. 7A and 7B are views similar to FIGS. 6B and 6C of yet another alternate embodiment wherein the spring biasing means utilizes a double chamfer to define a centering stop means.
Figure 7B:
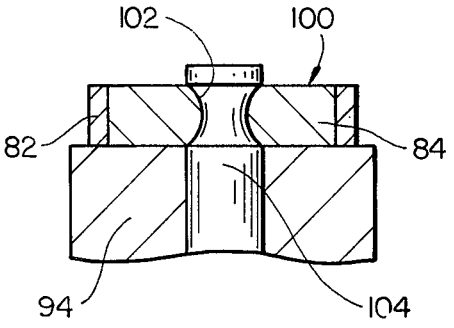

FIGS. 7A and 7B are before and after the recovery views similar to FIGS. 6B and 6C. FIGS. 7A and 7B illustrate a device 100 which is structurally identical to device 80 with the exception that the spring biasing means 84 is provided with a double chamfered surface 102 shown as a rounded edge. It can be seen that recovery of driver member 82 will cause engagement between double chamfered surface 102 and the complementary surface of pin 104 to define a centering stop means to secure substrate 94.

Figure 8:
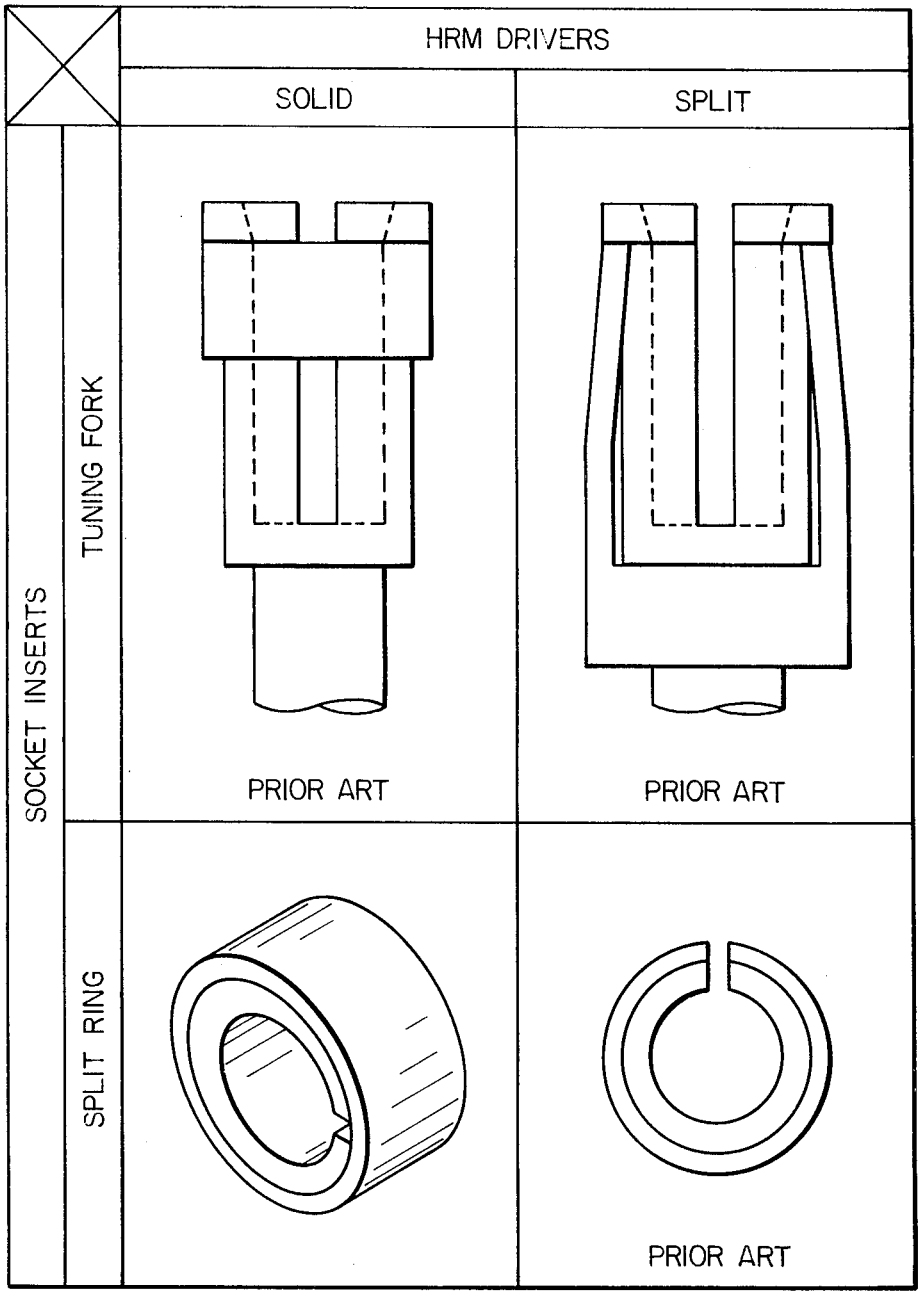
FIG. 8 illustrates in chart fashion the difference between the device of the instant invention and prior art devices utilizing heat-recoverable metal drivers and socket inserts.

FIG. 8 illustrates in chart fashion the significant difference between the basic device of the instant invention and the prior art devices utilizing heat-recoverable metal drivers and socket inserts. The chart of FIG. 8 catagorizes devices using a heat-recoverable metal driver that is either solid (annular and having a continuous inside contact surface) or split (circumferentially split). Contained within the heat-recoverable metal drivers that are either solid or split are socket inserts which in turn are catagorized as being either split rings (circumferentially split annular members) or as tuning forks.

Prior art devices have utilized the combination of a tuning fork socket insert and a solid heat-recoverable metal driver. Such devices have been discussed in the background of the invention with respect to the '030 and '839 patents. These devices utilize spring biasing in the form of a tuning fork having tines to expand a surrounding solid driver. As previously discussed, to generate high substrate contact forces, the driver should produce hoop stresses rather than bending stresses. This means that the driver must be continuous, i.e., solid. The problem of expanding a solid driver is solved by a tuning fork. The length of the composite device is determined by the length of the tines rather than the length of the driver. In contrast, the expanding of a solid driver is accomplished in the instant invention by a spring biasing means that is a split ring whose length is identical to that of the driver, i.e., it is wholely contained within the driver. To put this in perspective, it can be seen in FIG. 8 that a tuning fork type device is approximately three times greater in length than the instant invention for the same high substrate contact force.

The use of a tuning fork socket insert in combination with a split heat-recoverable metal driver is also illustrated. Previously discussed patent application '161 fully discloses such a device wherein the tines of the tuning fork socket insert are driven by a split driver in the form of cantilevered arms to produce a connector having a large range of movement. Unfortunately, this device will generate low substrate contact force since its driver is split (recovery in bending versus recovery due to hoop forces generated by a solid driver) and is tine-length dependent.

A combination of a split ring socket insert and a split heat-recoverable metal driver was discussed with respect to patent '444. This combination results in a device which exerts low substrate contact force due to its split driver but which is in fact compact relative to the tuning fork type devices.

The instant invention utilizes a split ring socket insert and a solid heat recoverable metal driver. It can be seen that the resultant combination produces a device which can generate the high substrate contact forces associated with a solid driver and its length is determined by the length of the driver alone.

While the invention has been particularly shown and described with reference to the preferred embodiments thereof, it will be understood by those skilled in the art that the foregoing and other chages in form and details may be made therein without departing from the spirit and scope of the invention, limited only by a just interpretation of the following claims.

What is claimed is:

1. A reusable connecting device comprising:

an annular driver member having a continuous inside contact surface, said driver member being made from a heat-recoverable metal having a martensitic state and an austenitic state, said driver member being expanded radially outward while in its martensitic state, a change from its martensitic state to its austenitic state recovering said driver member to its non-expanded dimension; and at least one circumferentially split annular spring biasing means inside and generally concentric with said driver member, said spring biasing means contacting and exerting a radially outward force against the inside contact surface of said driver member, said driver member overcoming said force when changed from its martensitic state to its austenitic state recovering to its non-expanded dimension causing engagement between said spring biasing means and a substrate that may be inserted inside of said spring biasing means, said spring biasing means expanding said driver member radially outward releasing such a substrate when said driver member changes from its austenitic state to its martensitic state.

2. A device as set forth in claim 1 wherein said spring biasing means is generally C-shaped.

3. A device as set forth in claim 2 wherein said spring biasing means comprises a middle section and two end sections, said middle section being thicker in radial cross section than said end sections, recovery of the driver member effecting an diametrical reduction of the spring biasing means.

4. A device as set forth in claim 2 wherein said spring biasing means includes two end sections, said end sections each having generally parallel abutting surfaces which are at an angle to the radial axis of said spring biasing means to define sliding surfaces, recovery of the driver member effecting a diametrical reduction of the spring biasing means and further causing one of said end sections to slide generally radially inward effecting a further reduction of the engagement dimension of said spring biasing means.

5. A device as set forth in claim 2 wherein said spring biasing means includes a pair of end sections, said end sections extending in parallel, spaced apart fashion radially inward to define a substrate engagement space therebetween.

6. A device as set forth in claim 2 wherein the spring biasing means comprises a disk-like member having a center opening, the periphery of said opening comprising at least one chamfered surface.

7. A device as set forth in claim 6 wherein the periphery of said opening comprises more than one chamfered surface.

8. A device as set forth in claim 1 wherein a plurality of axially aligned spring biasing means are provided.

9. A device as set forth in claim 2 wherein a plurality of axially aligned spring biasing means are provided.

10. A device as set forth in claim 3 wherein a plurality of axially aligned spring biasing means are provided.

11. A device as set forth in claim 4 wherein a plurality of axially aligned spring biasing means are provided.

12. A device as set forth in claim 1 wherein said spring biasing means is circumferentially split in the form of a helix.

13. A device as set forth in claim 1 wherein said spring biasing includes a conductive element for electrical connection.

14. A device as set forth in claim 3 wherein said spring biasing includes a conductive element for electrical connection.

15. A device as set forth in claim 4 wherein said spring biasing includes a conductive element for electrical connection.

16. A device as set forth in claim 5 wherein said spring biasing includes a conductive element for electrical connection.

* * * * *

UNITED STATES PATENT AND TRADEMARK OFFICE

CERTIFICATE OF CORRECTION

PATENT NO. : 4,462,651

DATED : July 31, 1984

INVENTOR(S) : Thomas H. McGaffigan

It is certified that error appears in the above-identified patent and that said Letters Patent is hereby corrected as shown below:

Column 6, line 67, "composition" should read -- comparison -.

Signed and Sealed this

*Twenty-sixth* Day of *February 1985*

[SEAL]

*Attest:*

DONALD J. QUIGG

*Attesting Officer* *Acting Commissioner of Patents and Trademarks*